US006161694A

United States Patent [19]

Gedack

[11] Patent Number: 6,161,694

[45] Date of Patent: Dec. 19, 2000

[54] PACK FOR A LINEAR LAMP

[75] Inventor: Horst Gedack, Munich, Germany

[73] Assignee: Patent-Treuhand-Gesellschaft fuer elektrische Gluehlampen mbH, Munich, Germany

[21] Appl. No.: 09/498,600

[22] Filed: Feb. 7, 2000

[30] Foreign Application Priority Data

Mar. 4, 1999 [DE] Germany ..... 199 09 531

[51] Int. Cl.[7] ..... B65D 85/42

[52] U.S. Cl. ..... 206/418; 206/470; 206/782; 206/806; 229/153; 229/162; 229/164

[58] Field of Search ..... 206/418–420, 206/461, 466, 470, 806, 443, 446, 775, 782, 783; 229/108, 112, 162, 153, 164

[56] References Cited

U.S. PATENT DOCUMENTS

| | | | |
|---|---|---|---|
| 2,346,206 | 4/1944 | Broderick . | |
| 3,249,213 | 5/1966 | Palmer | 229/162 |
| 3,493,103 | 2/1970 | Cote | 206/420 |
| 3,625,411 | 12/1971 | Cote | 206/806 |
| 4,106,615 | 8/1978 | Hiroshi | 206/806 |
| 4,378,903 | 4/1983 | Sherwood | 206/806 |
| 4,457,431 | 7/1984 | Lundquist et al. | 206/806 |
| 4,921,099 | 5/1990 | Trauschke | 206/418 |
| 4,949,845 | 8/1990 | Dixon . | |
| 5,842,632 | 12/1998 | Van Hest | 206/806 |

FOREIGN PATENT DOCUMENTS

| | | |
|---|---|---|
| 0 567 182 A1 | 10/1993 | European Pat. Off. . |
| 0 621 204 A1 | 10/1994 | European Pat. Off. . |

*Primary Examiner*—Luan K. Bui
*Attorney, Agent, or Firm*—William E. Meyer

[57] ABSTRACT

The invention relates to a unit pack for a linear lamp. The pack is designed as a single-piece tubular folding box. It has four side walls (10, 11, 12, 13) which form a tubular sleeve of trapezoidal cross section. At its top end, the folding box is provided with an integrally formed hanging tab (15).

4 Claims, 3 Drawing Sheets

PACK FOR A LINEAR LAMP

TECHNICAL FIELD

The invention relates to a pack for a linear lamp.

BACKGROUND ART

Such a pack is disclosed, for example, in German Utility Model G 93 06 272.9. This utility model describes a single-piece folding box which consists of cardboard or corrugated board and is intended for receiving a linear electric lamp. The folding box has three side walls which form a cylinder of triangular cross section. The two ends of said folding box are each closed by two closure tabs which form a cross closure.

DISCLOSURE OF THE INVENTION

The object of the invention is to provide a pack which is intended for a linear lamp and which has a punched-out formation for hanging the pack on a display wall provided with standardized hooks and which requires less packaging material than the prior art.

The pack according to the invention is designed as a tubular sleeve of trapezoidal cross section, the tubular sleeve being formed by a first side wall, which forms the rear side of the sleeve, and a second side wall, which forms the front side of the sleeve, and two further, sloping side walls. The second side wall, which is designed as the front side of the sleeve, is of a smaller width than the first side wall, which is designed as the rear side of the sleeve. At one end, the rear side has a tab which projects beyond the tubular sleeve and is provided with a punched-out formation for hanging the packaged lamp on a display wall provided with standardized hooks. On account of the abovementioned features, the pack according to the invention requires less material-related outlay than a comparable pack of rectangular or triangular cross section, as is explained in more detail hereinbelow.

With relatively thin linear lamps, for example with T8 fluorescent lamps, the minimum width of the pack is determined by the width of the punched-out formation rather than the external diameter of the lamp. At least one side wall of the pack therefore has to be at least as wide as the punched-out formation. With a pack of rectangular cross section, the front side and rear side are of the same width, that is to say at least the width of the punched-out formation, while the minimum height of the pack is defined by the external diameter of the lamp. With the pack according to the invention, it is only the rear side which has the minimum width defined by the punched-out formation, while the front side is of narrower design. This results in considerable material-related savings for the pack according to the invention in relation to the pack of rectangular cross section. A pack of triangular cross section likewise involves less favorable use of packaging material than the pack according to the invention because a pack of triangular cross section and predetermined minimum width for the base surface would considerably exceed the minimum height of the pack defined by the external diameter of the lamp.

In order to use as little packaging material as possible, the pack according to the invention is advantageously designed such that the width of its rear side is only the same size as the width of the punched-out formation. The tab which is provided with the punched-out formation and is integrally formed on the rear side is advantageously of double-walled design and the arresting means of that end of the tubular sleeve which is provided with the tab is designed as a locking tab, an edge of the double-walled tab forming a stop for the locking tab. The lamp is introduced into the trapezoidal sleeve from the other end and, in this case, presses against the locking tab, which thus rests on the stop-design edge of the double-walled tab and prevents the lamp from sliding out at said end provided with the locking tab. The other end of the pack is advantageously secured, against the lamp sliding out, by means of an angle element which can be folded back into the interior of the pack. Once the angle element has been folded back into the interior of the pack, it serves as a stop for the lamp arranged in the pack. For production reasons, the pack according to the invention is advantageously designed in a single piece and advantageously comprises a single-piece corrugated-board blank or cardboard blank.

BRIEF DESCRIPTION OF THE DRAWINGS

The invention is explained in more detail hereinbelow with reference to a preferred exemplary embodiment. In the figures.

BEST MODE FOR CARRYING OUT THE INVENTION

Figure 1:
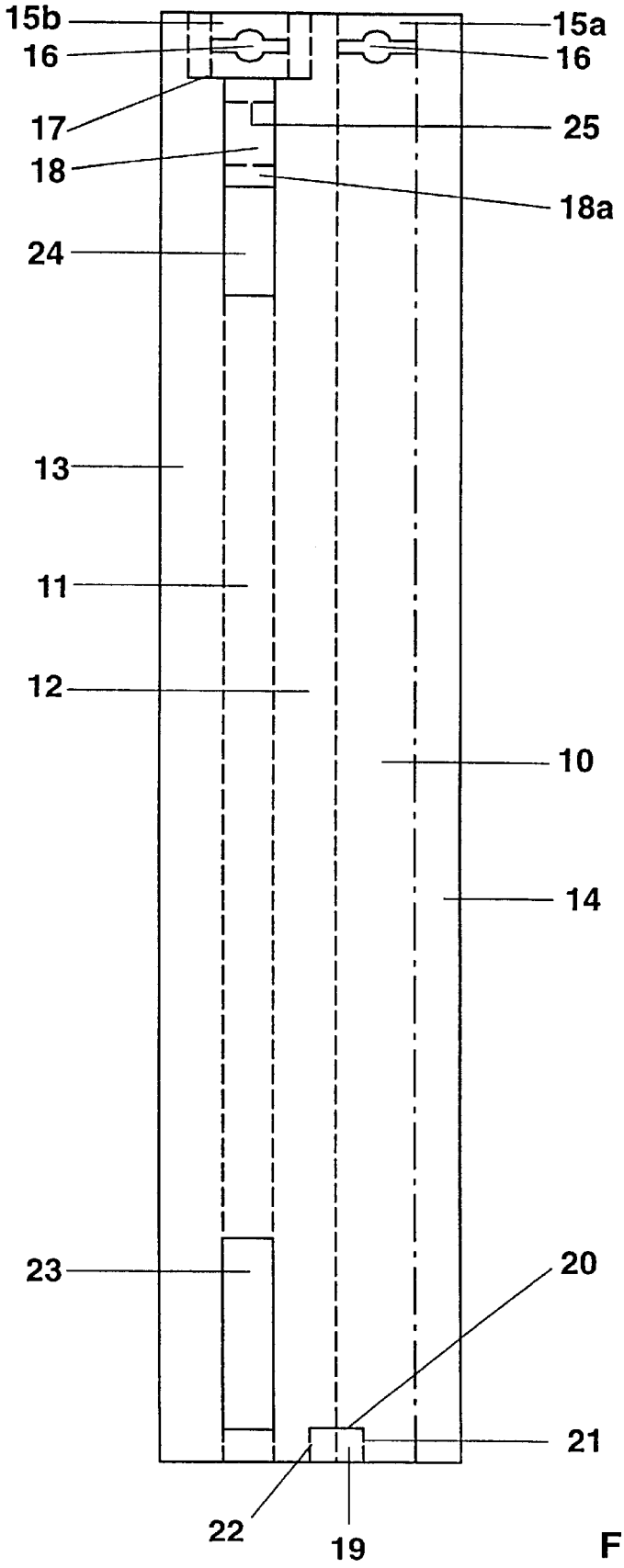
FIG. 1 shows an illustration of the cardboard blank or corrugated-board blank of the preferred exemplary embodiment of the invention.
Figure 2:
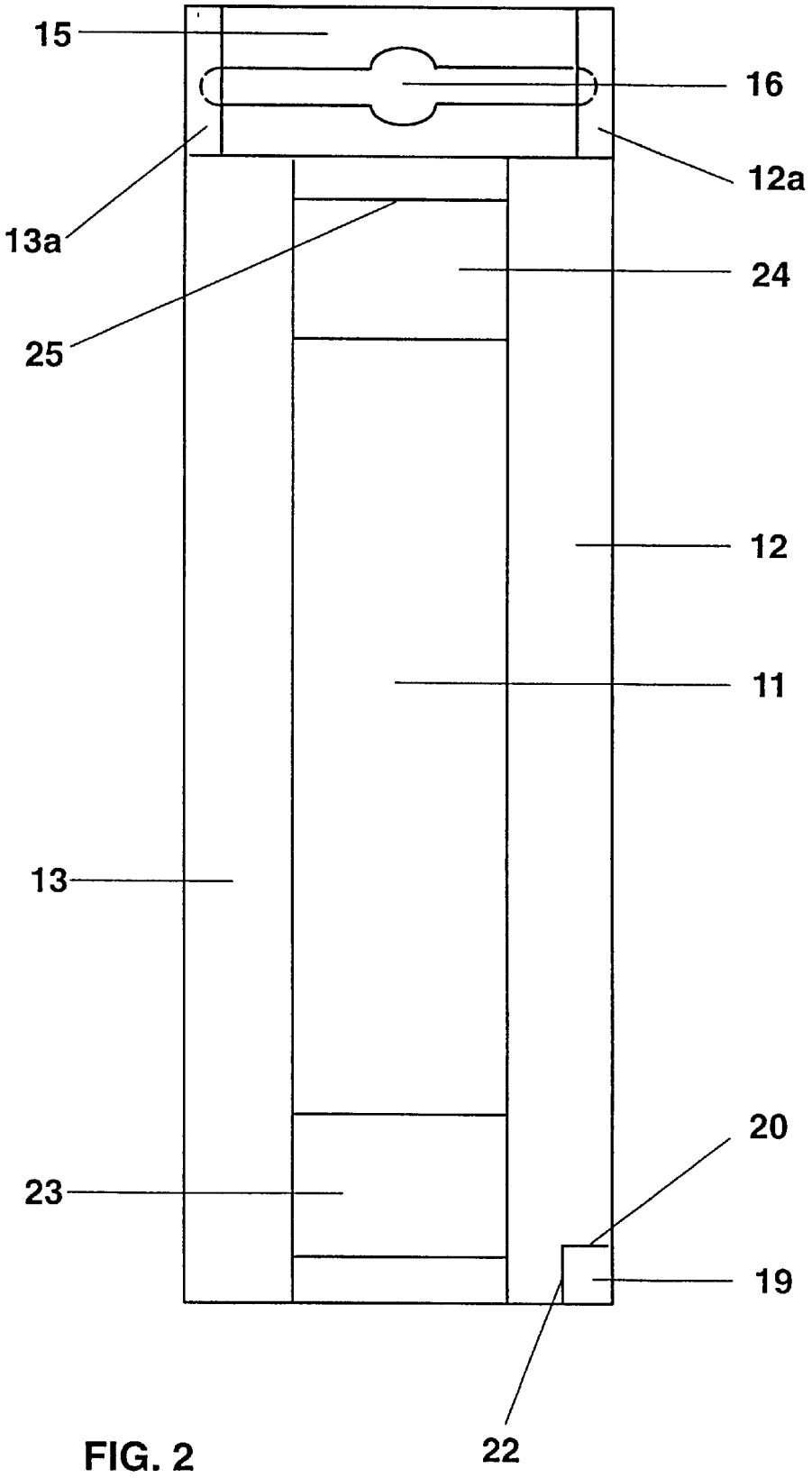
FIG. 2 shows a plan view of the front side of the pack according to the preferred exemplary embodiment.
Figure 3:
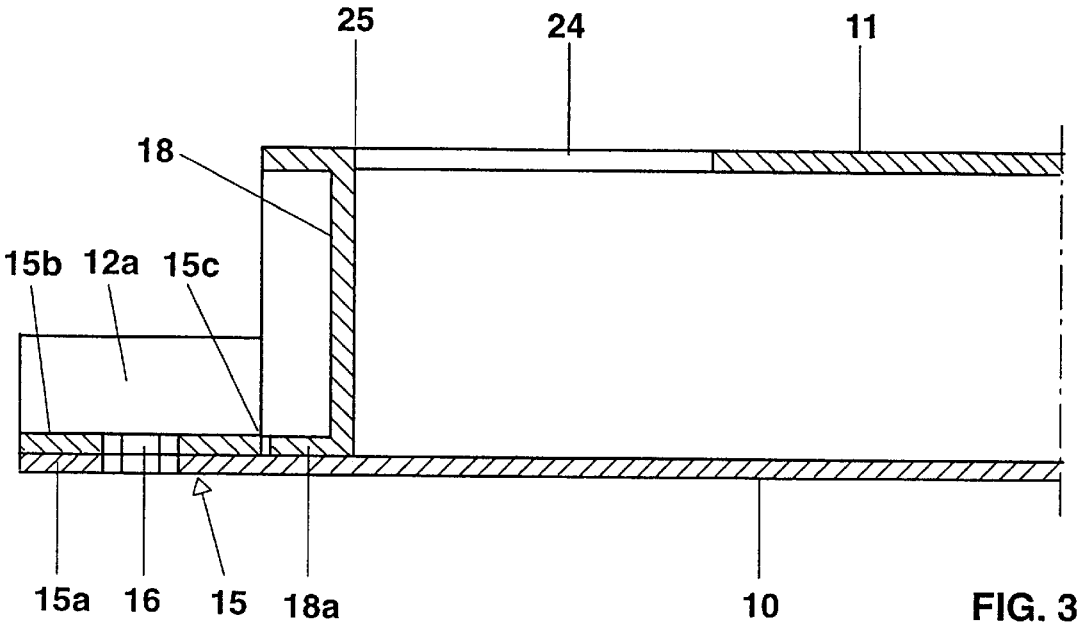
FIG. 3 shows a longitudinal section through that end of the pack according to the preferred exemplary embodiment which is provided with the punched-out formation.
Figure 4:
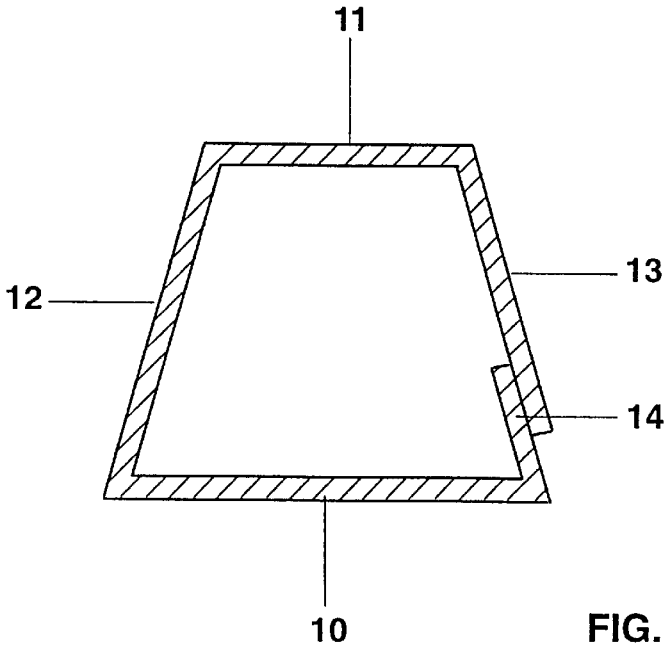
FIG. 4 shows a cross section through the pack according to the preferred exemplary embodiment.

The pack according to the preferred exemplary embodiment of the invention is a single-piece folding box made of corrugated board which is intended for a linear T8 fluorescent lamp and has an external diameter of more or less 26 mm. This pack is produced from a single-piece corrugated-board blank according to FIG. 1. In FIG. 1, the dashed lines illustrate folding edges and the solid lines illustrate cutting edges. The pack has four side walls 10, 11, 12, 13 and an adhesive tab 14, which form a tubular sleeve of trapezoidal cross section. The first side wall 10 forms the rear side of the trapezoidal sleeve and the second side wall 11 forms the front side of the sleeve, said front side running parallel to the rear side. The rear side is of a width of approximately 37.5 mm while the front side is of a width of approximately 23 mm. The other two side walls 12, 13 form the sloping side walls of the trapezoidal sleeve. They are of a width of 29 mm in each case. The length of the trapezoidal sleeve is selected such that it fully encloses, over its entire length, the lamp which is to be packaged therein. Integrally formed on the rear side 10 is a tab 15 which projects beyond the top end of the trapezoidal sleeve and is of double-walled design. The tab 15 has a slot-like punched-out formation 16 which extends over the entire width of the rear side 10 and of the tab 15. The punched-out formation 16 serves for hanging the packaged lamp on a display wall provided with standardized hooks, such display walls usually being used in self-service stores. The underside 15*a* of the double-walled tab 15 is formed from material of the rear wall 10 and the top side 15*b* is formed from the material of the front side 11. The double-walled tab 15 is produced by cutting into the front side 11 and the side walls 12, 13 along the cutting line 17 and then folding back onto the rear side 10 the material 15*b* separated off from the front side 11 by the cutting line 17.

The resulting tab 15 has, to the sides in each case, a web 12*a*, 13*a* which bounds the tab 15 and the punched-out formation 16. The top end of the pack, which is provided with the double-walled tab 15, is locked by a locking tab 18, which prevents the lamp from sliding out. The locking tab 18 is integrally formed, via a folding edge, on the top edge 25 of a viewing window 24 provided in the front side 11 at the top end of the folding box. In order to close the top folding-box end, the locking tab 18 is folded back, along folding edge 25, into the interior of the trapezoidal sleeve through an angle of 90 degrees. The angled free end 18*a* of the locking tab 18 butts against the edge 15*c* of the tab 15, said edge being formed by the top side 15*b*. The edge 15*c* serves as a stop for the angled end 18*a* of the locking tab 18 and thus prevents the lamp from sliding out of the top folding-box end. Since the locking tab 18 is arranged between the edge 15*c* and the lamp accommodated in the folding box, it cannot open of its own accord.

Once the lamp has been introduced into the trapezoidal sleeve, the bottom end of the pack is locked by the angle element 19, which is arranged at the bottom pack end, being folded back into the interior of the folding box. The angle element 19 is produced with the aid of the cutting line 20, which runs perpendicularly to the folding edge between the adjacent side walls 10, 12 and extends over said folding edge, and by means of two folding edges 21, 22 perpendicular to the cutting line 20. At its bottom end, the folding box has an additional viewing window 23 in the front side 11. Both viewing windows 23, 24 extend over the entire width of the front side 11. They serve for rendering accessible the product information printed on the bulb of the lamp.

What is claimed is:

1. A pack for a linear lamp, the pack having a tubular sleeve, which is formed by at least three side walls (10, 11, 12, 13), and a punched-out formation (16) which serves for hanging the pack on a hook of a display wall, and both ends of the tubular sleeve each being provided with an arresting means (18, 19) for fixing the lamp in the pack, wherein the tubular sleeve has a trapezoidal cross section, the tubular sleeve has a first side wall (10), which forms a rear side, and a second side wall (11), which forms a front side, and a third sloping side wall (12), a fourth sloping side wall (13), the second side wall (11) being of smaller width than the first side wall (10), at one end, the first side wall (10) has a tab (15) which projects beyond the tubular sleeve, the punched-out formation (16) is arranged in the tab (15) wherein the tab (15) has a double-walled form and the arresting means (18) on the end of the tubular sleeve which is provided with the tab (15) is designed as a locking tab (18), an edge (15*c*) of the double-walled tab (15) forming a stop for the locking tab (18), and wherein the front side (11) has a viewing window (24) in the region of the end provided with the tab (15), and the locking tab (18) is integrally formed on an edge (25) of the viewing window (24) and is folded back into the interior of the tubular sleeve.

2. The pack as claimed in claim 1, wherein the width of the rear side (10) corresponds to the width of the punched-out formation (16).

3. The pack as claimed in claim 1, wherein the pack is formed from a single piece.

4. The pack as claimed in claim 1, wherein the pack consists of corrugated board or cardboard.

* * * * *